US006619361B1

(12) United States Patent
Swinburne

(10) Patent No.: US 6,619,361 B1
(45) Date of Patent: Sep. 16, 2003

(54) MULTI-HEADED AUTOMATED LABELER

(75) Inventor: Stephen Swinburne, Scarborough, ME (US)

(73) Assignee: Engineered Automation of Maine, Scarborough, ME (US)

( * ) Notice: Subject to any disclaimer, the term of this patent is extended or adjusted under 35 U.S.C. 154(b) by 59 days.

(21) Appl. No.: 09/844,633

(22) Filed: Apr. 27, 2001

Related U.S. Application Data

(60) Provisional application No. 60/200,242, filed on Apr. 28, 2000.

(51) Int. Cl.[7] ..... B65C 9/08; B65C 9/40

(52) U.S. Cl. ..... 156/539; 156/362; 156/540; 156/542; 156/DIG. 28; 156/DIG. 44

(58) Field of Search ..... 156/539, 540, 156/541, 542, DIG. 24, DIG. 28, DIG. 35, 362, 363, 367, 368, DIG. 44

(56) References Cited

U.S. PATENT DOCUMENTS 4,210,484 A * 7/1980 Crankshaw et al. ..... 156/542
4,425,181 A * 1/1984 Bahr et al. ..... 156/497
5,387,302 A * 2/1995 Bernard et al. ..... 156/352
5,645,680 A * 7/1997 Rietheimer ..... 156/447
5,902,450 A * 5/1999 Jones ..... 156/542
6,412,535 B1 * 7/2002 Barilovits et al. ..... 156/362
6,440,249 B1 * 8/2002 Swinburne ..... 156/230

FOREIGN PATENT DOCUMENTS

JP 2001315736 A * 11/2001 ..... B65C/9/36

* cited by examiner

*Primary Examiner*—Richard Crispino
*Assistant Examiner*—Sue A. Purvis
(74) *Attorney, Agent, or Firm*—Patricia M. Mathers; Thomas L. Bohan

(57) ABSTRACT

A multiple-head labeling machine directed at minimizing downtime, both from the need to reload labels and from the occasional labeler jams, on assembly lines incorporating a labeling step. It achieves this by the use of multiple independent labeling mechanisms gang-loaded on a single apparatus, such apparatus being capable of switching back and forth between the independent labeling mechanisms. This provides for a depleted or jammed mechanism to be displaced in a matter of seconds with a fresh mechanism that is ready to continue with the labeling operation.

19 Claims, 2 Drawing Sheets

MULTI-HEADED AUTOMATED LABELER

CROSS-REFERENCE TO RELATED PROVISIONAL APPLICATION

This application claims the benefit of U.S. Provisional Application No. 60/200,242, filed on Apr. 28, 2000.

BACKGROUND OF THE INVENTION

1. Field of Invention

The present invention relates to apparatus used in the automated application of labels to objects. More particularly, the present invention relates to apparatus for applying labels to items prepared using automated packaging/labeling assembly lines. More particularly yet, the present intention relates to such apparatus that eliminates the need for assembly line shutdown for the loading of label stock whenever the existing label stock runs out. Even more particular yet, the present invention relates to such apparatus that incorporates multiple labeling heads in order to provide for the rapid introduction of a new label stock whenever the stock associated with a particular head becomes exhausted.

2. Discussion of Related Art

In modern assembly-line production of products for mass-market, an important stage in the process is product and packaging labeling. The use of automated labeling machines is common in today's fast paced production and packaging lines. Typically, such machines are loaded with a roll or other configuration that contains a large number of the labels to be applied, one for each item as the item passes by or under the labeling machine. The labeling operation then typically consists of a portion of the labeling machine called the labeling "head" making direct or indirect contact with each item so as to convey a single label to that item. Although there is a wide diversity of such machines reflecting the wide diversity of specific labeling needs, essentially all of these machines involve such a process and incorporate a component identifiable as a labeling head.

The rate at which items are processed on modern production/packaging assembly lines is overwhelming to the uninitiated observer, and represents one of the major reasons why so many mass production products can be delivered so inexpensively to the end consumer. One of the necessary consequences of this cost-reducing efficiency is the high cost associated with interruptions to the assembly line for even a short period of time. For those lines that have been developed to the point where mechanical breakdowns seldom occur, the major source of production shutdown is during the replenishment of supplies needed by the machinery processing the items. Specifically of interest to the present inventor is the delay that occurs when a load of labels runs out. Typically, when a roll of labels is exhausted, the assembly line has to be shut down while an attendant removes the spent label-container and replaces it with a new one containing labels. In addition to this production downtime, most industries require that a separate operator verify that the first operator reloaded the machine with the correct labels.

Recognizing the inefficiency associated with the need to change reels on automated labeling machines, a number of attempts have been made to circumvent the inefficiencies traditionally associated with the reel-changing. There are, for example, "double unwind" systems that provide an attendant the means, as an existing label reel is reaching its end, to attach the trailing end of that reel to the leading end of a new reel, thereby avoiding the need to stop the operation. However, because of the difficulty presented by the high speed of the operation, it is not a simple matter to operate the double-unwind system. Equally as troublesome is the high cost of labeling machines incorporating such provisions. Presently, these costs are on the order of $20,000 per machine. Added to this must be the cost of the attendant who must actively participate in the reel-transition operation. Although more complex machines that automate the reel-transition operation exist, those machines are far more expensive than their non-automated reel-transition counterparts.

In addition to the production stoppages necessitated by reloading label, all equipment is afflicted by occasional malfunctions. Labeling machines, where the malfunction primarily takes the form of jamming, are no exception. When a jam occurs, production is shut down until an operator can clear the jam and re-initiate the label feed. Neither the double-unwind machines requiring attendant participation nor the very expensive fully automated double-unwind machines address the problem of delays due to jamming and other production-halting mishaps with the labeling operation.

Therefore, what is needed is a labeling apparatus that eliminates or greatly reduces the delay associated with re-loading label stock at a relatively low cost. What is also needed is such apparatus that reduces the delay associated with labeling mis-feeds, jams, and other production-halting mishaps with the labeling operation.

SUMMARY

The present invention greatly reduces the delay associated with reloading label stock, and it does this without imposing the costs inherent in the earlier attempts to solve this problem. Using the same concept that reduces the delay associated with reloading label stock, the present invention also eliminates the delays and costs traditionally associated with labeling mis-feeds and other malfunctions. The present invention accomplishes these functions by incorporating multiple independent label-feed mechanisms into standard industry production labelers. For definitiveness the discussion of the invention will often address only those embodiments that have just two such mechanisms; however, in general, the invention need not be so limited and is not.

Each of the independent label-feed mechanisms of the present invention will have a mounting means for a reel of label stock as well as a label head by which each label is serially transferred from the reel to the item to be labeled. Also included in each of the multiple mechanisms is the mechanical means for advancing the label reel down to and through the label head. The individual label-feed mechanisms are gang-loaded onto a slide frame and controlled in such a way that, when the label reel of one of the independent mechanisms reaches its final label, the entire operation is momentarily shut down. The ganged labeling mechanisms are then shifted sideways on the slide frame in such a manner that a "loaded" label head is now poised above the items to be labeled in exactly the same place as the now-empty-of-labels head had been just before the shutdown, i.e. the active labeling site. The total shutdown time for this operation can be as short as a few seconds. As part of the general monitoring of the production operation, an operator can, at his or her leisure or as part of a operator-dictated (as opposed to machine-dictated) schedule, without halting production, replace the depleted reel on the labeling mechanism that had been shifted out of active use with a full reel, thus enabling it to be shifted back into active use when the other mechanism in turn runs out of labels or becomes jammed.

By using this multiplicative approach, the apparatus of the present invention can minimize reel-transition time without the complexities of either type of "double unwind" machinery of the prior art. While it is true that the apparatus of the present invention cannot cut the label-restocking transition time below what the expensive automated double-winded machinery of the prior art can achieve, it does so at a lower cost. Moreover, by having a fully-charged label reel always ready to be introduced to the labeling operation at any time, the apparatus of the present invention is ideally suited to eliminate the down-time associated with label jamming. For example, the apparatus can be wired so as to detect a cessation of label reel rotation and to respond by shifting the apparatus, so that a non-jammed reel and associated mechanism is automatically moved into place as the jammed mechanism is moved away. Upon such an occasion, an operator can work with the jammed reel to free it up, without needing to stop production for the duration of this work. The apparatus can also be similarly wired so as to detect label head jams, and to similarly shift to the non-jammed labeling head so as to continue labeling with minimal interruption.

Although the present invention is not limited to any specific reel or head configuration or type of control, it is particularly suited to logic-based electronic control, where a single control unit governs the position of the gang of multiple mechanisms. This control then responds to any of a number of monitoring sensor alerts by shifting the array in one direction or the other. The monitoring sensors can be, but are not limited to, laser sensors, electronic sensors, optical sensors, or tactile sensors. The shifting can be accomplished by manual means, pneumatic means, an electric motor, or spring biases to name a few motive sources. In its simplest embodiments, the only choices are to shift the ganged labeling mechanisms one position to the right, or one position to the left. For example, a simple embodiment of the present invention will have two independent labeling mechanisms, a left independent labeling mechanism, and a right independent labeling mechanism. If the apparatus is currently labeling from the left independent labeling mechanism when an alert is received, the controller then shifts the ganged labeling mechanisms as to make the right independent labeling mechanism the current labeler. The control unit may also interact with other automated operations along the line itself, including conveyors, so that when the labeler is switching from one labeling mechanism to another, unlabeled product is not passing by. In another embodiment, the control unit may respond to sensing a labeling head jam or lack of labels by lighting an indicator light, sounding an alarm, or both. This indicator alerts the operator to manually slide the slidable frame into a position so as to place a fresh labeling mechanism over active labeling site.

It is to be noted that although types of automatic labeling apparatus that employ more than a single labeling head exist, all of those known to the present inventor that do so are directed to the function of applying more than a single label to a particular item. Furthermore, none of the known existing labelers are capable of shifting a labeling head into the same position that another labeling head had previously occupied.

Although for purposes of clarity, the present invention has been described with some specificity in this Summary and will be described with even more specificity in presenting its Preferred Embodiment, it is to be understood that from the disclosure contained herein, those skilled in the art of automated production equipment will be able to devise a great diversity of embodiments of the present invention, all of which inventor claims, as his invention.

DETAILED DESCRIPTION OF THE PREFERRED EMBODIMENT

Figure 1:
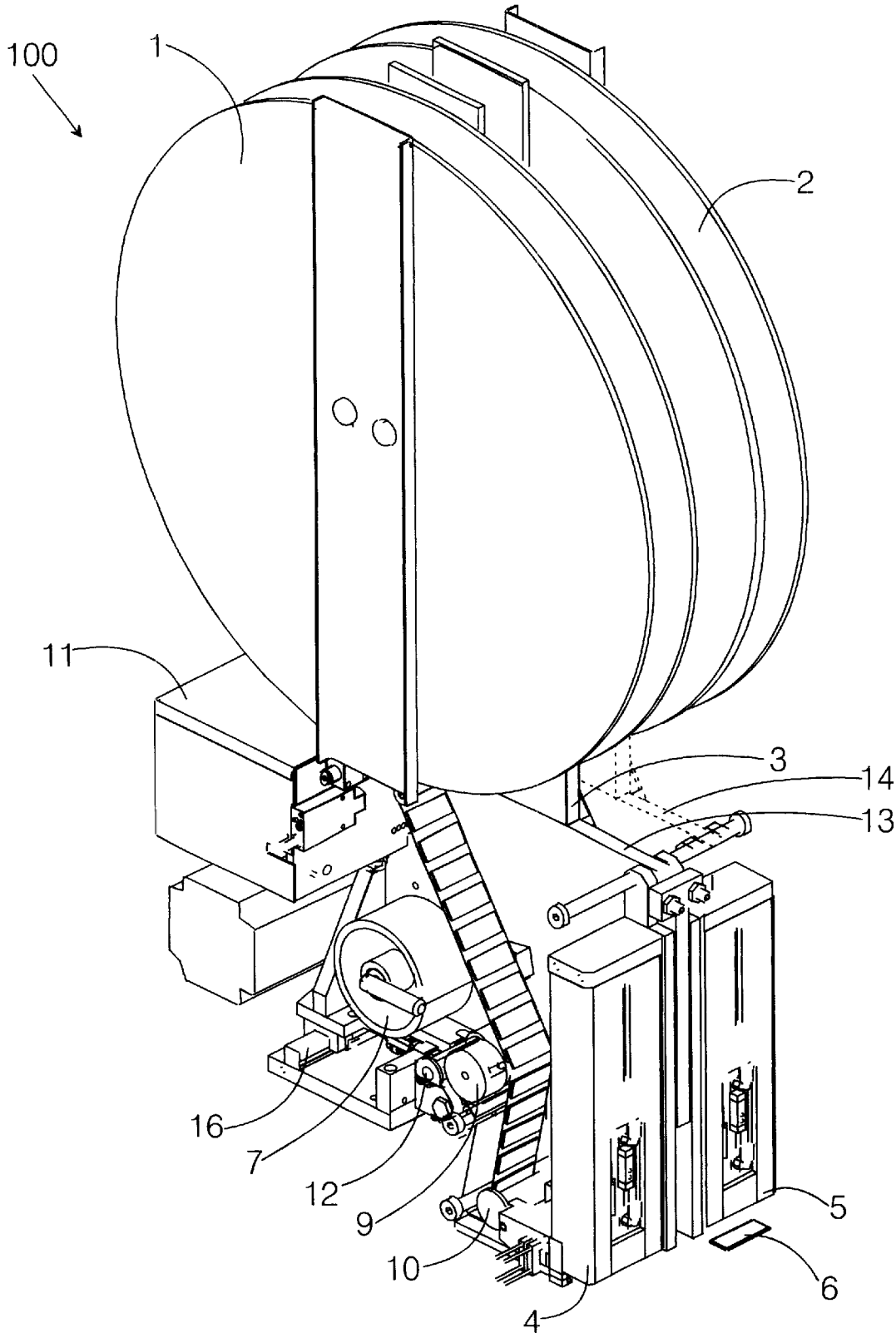
FIG. 1 is a front view of the Preferred Embodiment of the present invention, showing a dual-head automated labeling device.

In the Preferred Embodiment, the label mechanism, per se, is that of co-pending application Ser. No. 09/586,374 filed on behalf of the present inventor and assignee. FIG. 1 shows the Preferred Embodiment of the present invention, depicted generally as 100, which uses two independent labeling mechanisms. These independent labeling mechanisms contain a left label reel 1 and a right label reel 2, each detachably mounted onto a slidable frame 3. Also attached to slidable frame 3 are left labeling head 4 and right labeling head 5. In this illustration, right labeling head 5 is over the active label site 6, and therefore would be the active labeler in the depicted configuration. Also attached to slidable frame 3 is a left waste reel collector 7, which collects the waste label tape after left labeling head 4 removes and applies the label. A right waste reel collector also exists, but is not shown. In the Preferred Embodiment, a back left label guide 9 and a front left label guide 10 are mounted onto slidable frame 3 and serve to accurately guide the labels from the corresponding left label reel 1 and right label reel 2 to left label head 4 and right label head 5. Similar guides exist but are not shown for the right labels. A control unit 11 is shown in FIG. 1 mounted onto slidable frame 3. The control unit 11 contains semiconductor logic circuitry, that processes and responds to various electronic position sensors (not shown) commonly known in the art. In the Preferred Embodiment, control unit 11 responds to these various input sensors by triggering a pneumatic drive 12, which in turn mechanically slides slidable frame 3 either fight or left on guide track 16, thereby placing the desired labeling head over the active labeling site 6. If right label head 5 is currently the active labeler over active label site 6, and the control unit 11 senses either a jam or that the right label reel 2 is out of labels, the control unit 11 would then trigger pneumatic drive 12 to move slidable frame 3 on guide track 16 from its position 13 as shown to position 14 (indicated by dotted lines). Thus, when slidable frame 3 is in position 14, the left label head 4 is in position over the active label site 6, and labeling may resume. Now, at the operator's leisure, the emptied reel may be replaced or the jam cleared, so that when left label reel 1 is emptied or jammed, the control unit 11 may reverse the process and move slidable frame 3 back to position 13, thus returning right label head 5 back over the active label site 6.

Figure 2:
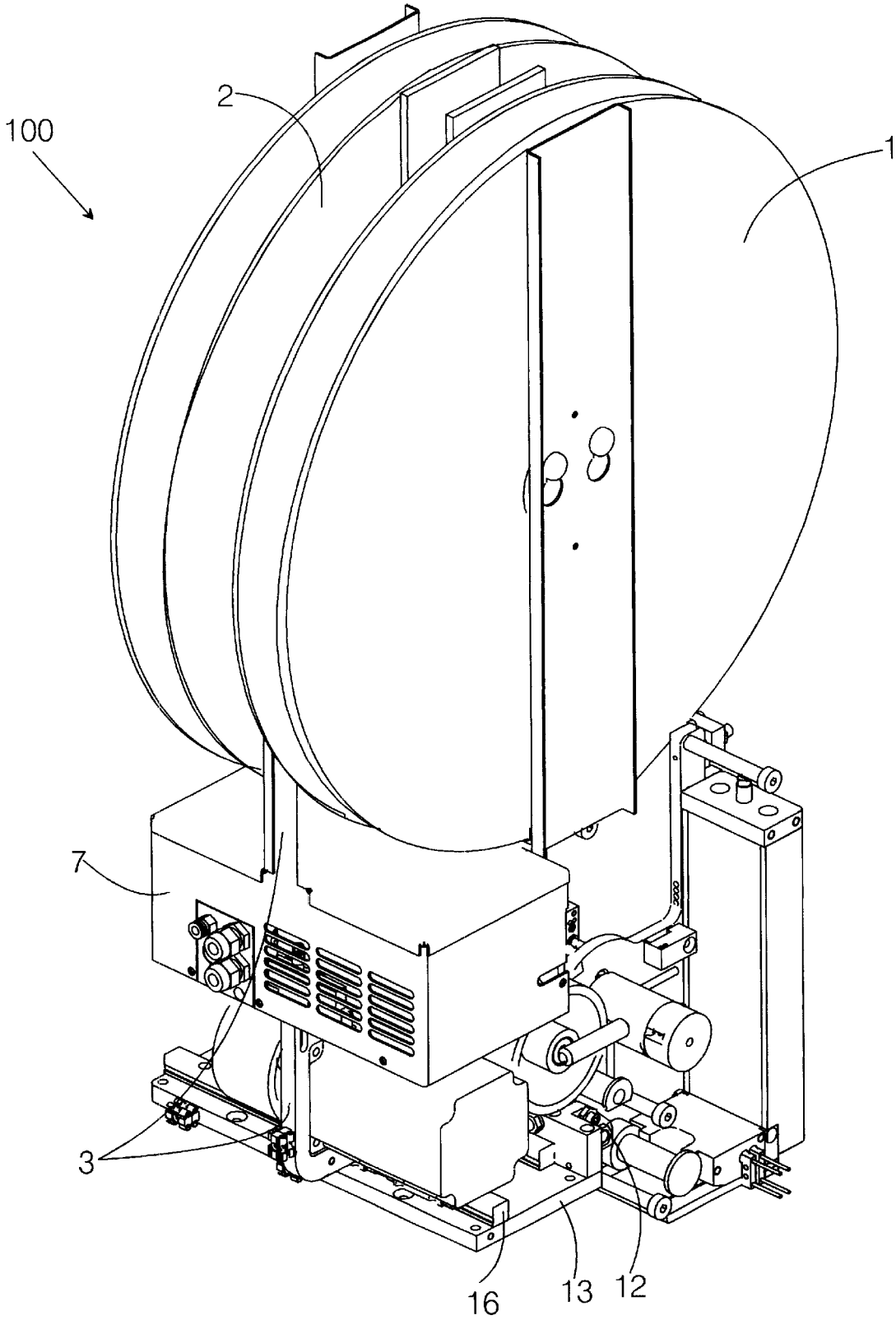
FIG. 2 is a rear view of the Preferred Embodiment of the present invention, showing the slidable fame, guide track, and motor.

FIG. 2 shows a rear view of the Preferred Embodiment of the present invention, depicted generally as 100. In this view, slidable frame 3 can be seen mounted onto the guide track 16. Control unit 7 responds to the referenced sensors (not shown), and causes the pneumatic drive 12 to move slidable fame 3 either left or right on guide track 16, depending on which labeling head (not shown) is being placed over active labeling site (not shown). Left label reel 1 and right label reel 2 can also be seen removably attached to slidable frame 3.

What is claimed is:

1. A labeling apparatus for applying a particular label at a single active labeling site that applies labels to a product, said labeling apparatus comprising:

a label reel carrying a plurality of labels, each of said labels being said particular label;

at least two labeling heads, each of said labeling heads adaptable for applying said particular label to said active labeling site; and a slidable frame;

wherein said labeling heads and said label reel are mounted on said slidable frame and said slidable frame is positionable between a first position in which a first one of said labeling heads is positioned over said active labeling site and an other position In which an other one of said labeling heads is positioned over said active labeling site.

2. The apparatus of claim 1 wherein said label reel includes a plurality of reels, said plurality corresponding in number to a number of said at least two labeling heads; and wherein each individual reel feeds said particular label to a respective one of said labeling heads.

3. The apparatus of claim 1 wherein said label reel is removably mountable on said slidable frame.

4. The apparatus of claim 1 further comprising a guide track, wherein said slidable frame is slidably mounted on said guide track.

5. The apparatus of claim 4 further comprising a means for shifting said slidable frame between said first position and said other position.

6. The apparatus of claim 5, wherein said means for shifting is a control unit that senses a state of inoperation of said first one of said labeling heads that is positioned over said active labeling site and shifts said slidable frame an said guide track so as to position said other one of said labeling heads over said active labeling site.

7. The apparatus of claim 6 further comprising one or more sensors, wherein said one or more sensors monitor a state of inoperation of said label reel that feeds said particular label to said first one of said labeling heads and send certain signals to said control unit, and wherein, when said certain sensor signals are received by said control unit, said control unit activates a driver to move said slidable frame so as to shift said first one of said labeling heads away from said active labeling site and said other one of said labeling heads over said active labeling site.

8. The apparatus of claim 7 further comprising an indicator, wherein, when said one or more sensors detect an inoperative state of said label reel, said one or more sensors then trigger said indicator so as to alert an operator to said inoperative state.

9. The apparatus of claim 8 wherein said indicator is a visual signal.

10. The apparatus of claim 8 wherein said indicator is an audio signal.

11. The apparatus of claim 7 wherein said control unit communicates with a subsequent device on a product processing line and de-energizes said subsequent device when an inoperative state occurs and re-energizes said subsequent device when an operative state occurs.

12. The apparatus of claim 11 wherein said subsequent device includes a conveyor.

13. The apparatus or claim 7, wherein said sensors include sensors from a group consisting of position, laser and other eye sensors.

14. The apparatus of claim 5 wherein said shifting means is a mechanical latch mechanism that is manually operated and wherein said slidable frame is shifted manually.

15. An improvement of a standard labeling apparatus commonly found on a product processing line for applying a particular label at a single active labeling site that applies labels to a product, said apparatus having a label reel, a labeling head, and a frame, said improvement comprising:

a modified frame slidably mounted on a guide track, said modified frame supporting two or more labeling heads, wherein, to provide labeling capability redundancy in said product processing line, a first one or an other one of said two or more labeling heads applies said particular label to said product at said active labeling site, and wherein said modified frame is switchable between a first position and an other position wherein, in said first position said first one of said labeling heads is positioned above said active labeling site, and in said other position, said other one of said labeling heads is positioned above said active labeling site.

16. The improvement of claim 15 further comprising an automated means for shifting said frame so as to switch between said first position and said other position.

17. The improvement of claim 16 further comprising a control unit with one or more sensors, wherein said sensors monitor said label reel for an inoperative state and send a signal to said control unit when said inoperative state occurs; and wherein said control unit then actuates said automated means for moving said frame respectively between said first position and said other position.

18. The improvement of claim 17 wherein said control unit communicates with other production processing devices, de-energizes said other production processing devices when said labeling head over said active labeling site is in an inoperative state and energizes said devices when said labeling head over said active labeling site is in an operative state.

19. A labeling apparatus for applying a particular label at a single active label site that applies labels to a product, said apparatus comprising:

at least two labeling heads and at least two label reels, each one of said label reels feeding said particular label to a corresponding one of said labeling heads;

a slidable frame;

a guide track;

a control unit and sensors; and and a means for shifting said slidable frame between a first position in which a first one of said labeling heads is positioned over said active label site and an other position in which an other one of said labeling heads is positioned over said active label site, wherein said at least two label reels and said at least two labeling heads are removably mountable on said slidable frame wherein said slidable frame is mounted on said guide track and is shiftable on said guide track between a first position in which a first one of said labeling heads is positioned above an active labeling site and an other position in which an other one of said labeling heads is position over said active labeling site.

* * * * *